United States Patent [19]

Lopez

[11] Patent Number: 4,688,800

[45] Date of Patent: Aug. 25, 1987

[54] GOLF SWING GUIDE

[76] Inventor: Julio C. Lopez, 3027 Vancouver Ave., San Diego, Calif. 92104

[21] Appl. No.: 887,621

[22] Filed: Jul. 21, 1986

[51] Int. Cl.[4] ..... A63B 69/36

[52] U.S. Cl. ..... 273/183 B; 273/186 C; 273/189 R

[58] Field of Search ..... 273/189 R, 191 R, 183 B, 273/188 A, 192, 186 C; 224/904, 913, 914; 224/224, 918; 128/95, 96, 78; 434/252

[56] References Cited

U.S. PATENT DOCUMENTS

| | | | |
|---|---|---|---|
| 2,671,899 | 3/1954 | Kroger | 128/96 X |
| 2,773,691 | 12/1956 | Redfield | 273/189 R |
| 3,346,152 | 10/1967 | Geisendörff | 224/224 |
| 4,294,239 | 10/1981 | Oram et al. | 128/96 |
| 4,592,342 | 6/1986 | Salmasian | 128/96 X |

FOREIGN PATENT DOCUMENTS

| | | | |
|---|---|---|---|
| 522814 | 6/1940 | United Kingdom | 273/191 R |

*Primary Examiner*—George J. Marlo

[57] ABSTRACT

A golf swing guide having a generally triangular configuration that will allow the golf student to swing a golf club as most golf teachers want their students to swing, otherwise the golf student will abruptly hit the golf swing guide with his elbow and will not be able to complete the back or downswing without severe interference from the golf swing guide with his elbow.

The golf swing guide is designed so that the golf student must start the back swing with his hands, arms and shoulders as a unit, allowing the hips to turn with the swing. The golf swing guide being buckled to the student's waist will also turn and allow the student's elbow to slide along the near part of the outer side. The downswing is initiated by the hips turning towards the target, again the golf swing aid will turn with the hip movement and allow the student's elbow to slide along the far part of the outer side. When the student's elbow clears the swing guide the student will have finished the swing high and towards the target.

1 Claim, 3 Drawing Figures

GOLF SWING GUIDE

BACKGROUND OF THE INVENTION

The present invention relates to a golf swing guide that will force the golf student to practice a complete golf swing with the correct plane, to achieve the desired swing and to learn the feel of the swing so that the feel will be natural and the student will become accustomed to the swing that the guide has forced him to learn.

SUMMARY OF THE INVENTION

Prior arts of other golf swing aids, although not similar to this invention, are too expensive to manufacture or too large and cumbersome to be portable enough to move from one place to another of your own back yard or do not relate to the complete golf swing.

The above mentioned negative aspects make it impractical for the average golfer to own one of the prior arts golf aids.

My golf swing guide invention does away with the afore mentioned negative aspects and makes it both practical and affordable for the average golfer to personally own one.

OBJECT OF THE INVENTION

One of the objects of the invention is to force the golf student to swing the golf club straight back and parallel to the ground on the back swing with the hands, wrists and arms as a single unit, to swing from the inside out on the down swing, to finish the swing high and to allow the golf student to know when he does not swing the golf club as the golf swing guide meant for the student to swing.

Another object is that a low handicap golfer can keep his swing in tune during the winter months or while on an absense from golf.

Figure 1:
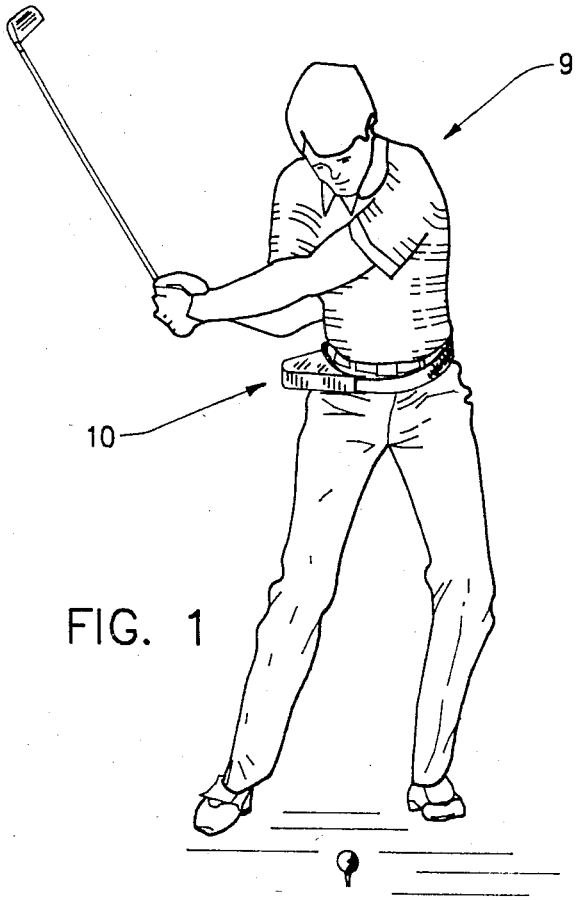
FIG. 1 illustrates how the student #9 should wear the golf swing guide with the guiding device #10 at approximately forty-five degrees to the side of the student's waist.
Figure 3:
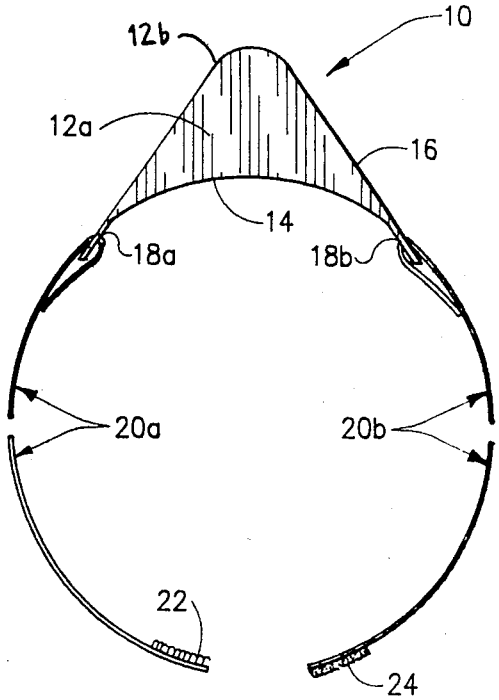
FIGS. 2 and 3 are two views of the complete assembly to make it easier to see and recognize all the parts from a different angle and to understand how they work in relation to the swing.
Figure 2:
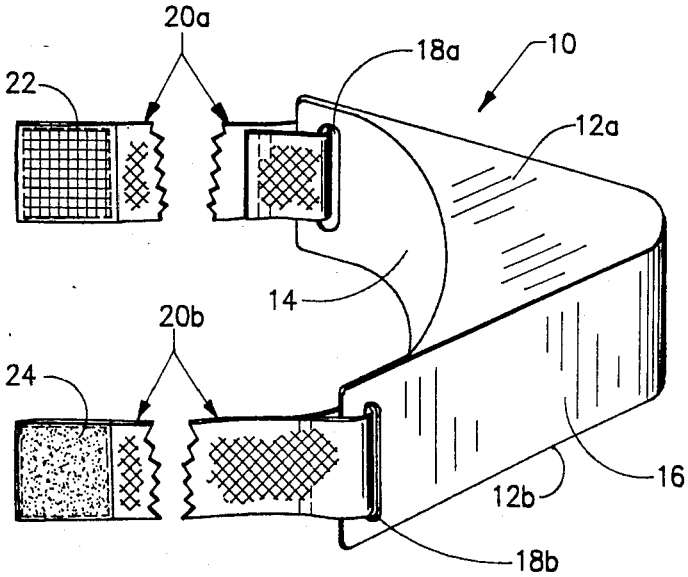

The basic parts are #10, #20A and #20B. You will note the indicating lines from the part numbers of said basic parts to the indicated parts have an arrowhead pointing to the appropriate part. The other part numbers have indicating lines without arrowheads. These indicating lines without the arrowheads point to the parts or sections that complete the three said basic parts. The complete list of parts and their function is:

No. 10 Guiding device,

Nos. 12A and 12B symetrically shaped top and bottom sides;

No. 14 inner side formed to fit the student's waist,

No. 16 outer side acts as the guide,

No. 18A and 18B a slot to accept,

Nos. 20A and 20B straps,

No. 22 is the eyelet half and

No. 24 is the hook half of the adhesive material that will adhere the ends of the straps around the student's waist to hold the golf swing guide in place.

DESCRIPTION OF THE PREFERRED EMBODIMENT

The golf swing guide worn on the right or left side of the student's body and set at about forty-five degrees to the front of the student's waist will force the student to start the backswing low and parallel to the ground, with the hands, arms and body as a single unit and to swing from the inside out on the downswing. If the student fails in any way to swing as explained above, the golf swing guide will interfere with the student's elbow making it almost impossible to continue the swing. By completing the downswing past the swing guide, the finish will automatically be high.

It is preferred that the student start his practice with a nine iron and work his way up to the driver as he becomes more proficient with the golf swing guide.

The student should keep the right or left elbow close to the body and next to the near side of the golf swing guide while he prepares to start the backswing. If, during the back swing, the elbow hits the near side of the swing guide the student should start the golf swing with his hands, wrists and arms as a unit, keeping the club head low and parallel to the ground then start to turn the hips so that the elbow clears the swing guide until the back swing is completed.

The golf student should practice the back swing for awhile before starting the downswing just to learn the feel of the backswing.

At the top of the back swing the elbow must again be kept close to the body and next to the far side of the golf swing guide. If the student again feels interference on the elbow from the golf swing guide, the student should take a full back swing, keep the elbow near the body and next to the golf swing guide and start the swing with the hips. On the downswing the elbow should remain behind the golf swing guide as long as possible and as the body turns the student should swing outwards a little to avoid contact with the golf swing guide. Swinging out will force the student's swing to be high by the time the elbow clears the golf swing guide.

It is obvious to the reader that a golf novice will not know how to use the golf swing guide but any golfer that has taken a lesson or two or a golfer that has played enough golf to know what he wants to do during the swing will understand and master the fundamentals of the golf swing and the concepts of how the golf swing guide works.

Obviously, many other modifications and variations of this invention are possible as compared to the above preferred embodiment; therefore, it is understood that within the scope of the disclosed inventive concept, the invention may be practiced and manufactured otherwise than as specifically described.

What I claim is:

1. A golf swing consisting of four sides, the inner side is concave to fit the convex contour of the student's waist, the outer side is defined by converging surfaces extending from the ends of the inner side to around juncture, the upper and lower sides match the configurations defined by the outer and inner sides said guide further including which has a slot adjacent the junction of the outer and inner sides a strap at each slot with a buckle device at the opposite ends to allow the student to buckle the straps with the golf swing guide around his waist: so that the guide may be worn and will allow the student to practice the golf swing.

* * * * *